US011525322B2

(12) United States Patent
Neacsu et al.

(10) Patent No.: US 11,525,322 B2
(45) **Date of Patent: *Dec. 13, 2022**

(54) FISH RETRIEVAL FROM WELLBORE

(71) Applicant: Saudi Arabian Oil Company, Dhahran (SA)

(72) Inventors: Marius Neacsu, Dhahran (SA); Ahmed A. Al-Ramadhan, Dammam (SA); Ahmed Al-Mousa, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 17/318,196

(22) Filed: May 12, 2021

(65) Prior Publication Data

US 2021/0262307 A1 Aug. 26, 2021

Related U.S. Application Data

(63) Continuation of application No. 16/544,616, filed on Aug. 19, 2019, now Pat. No. 11,035,190.

(51) Int. Cl.

| | |
|---|---|
| ***E21B 31/20*** | (2006.01) |
| ***E21B 23/00*** | (2006.01) |
| ***E21B 23/01*** | (2006.01) |

(52) U.S. Cl.

CPC ..... *E21B 31/20* (2013.01); *E21B 23/006* (2013.01); *E21B 23/01* (2013.01)

(58) Field of Classification Search

CPC ..... E21B 23/006; E21B 23/01; E21B 31/20

(Continued)

(56) References Cited

U.S. PATENT DOCUMENTS

| | | | | |
|---|---|---|---|---|
| 880,404 A | | 2/1908 | Sanford | |
| 1,033,655 A | * | 7/1912 | Baker | E21B 31/20 294/86.19 |

(Continued)

FOREIGN PATENT DOCUMENTS

| | | | | |
|---|---|---|---|---|
| CA | 2441138 | | 3/2004 | |
| CA | 2441138 A1 | * | 3/2004 | E21B 31/20 |

(Continued)

OTHER PUBLICATIONS

PCT International Search Report and Written Opinion in International Appln. No. PCT/US2020/046773, dated Nov. 2, 2020, 14 pages.

(Continued)

*Primary Examiner* — Jennifer H Gay
(74) *Attorney, Agent, or Firm* — Fish & Richardson P.C.

(57) ABSTRACT

An apparatus includes a housing, engagement slips, a tubular, a taper tap, a pin, and a slip activation member. The housing includes a profile that defines a path including a first end and a second end. The engagement slips are attached to the housing. The tubular passes through an opening of the housing. The taper tap is rotatable and connected to the housing. The pin is connected to the tubular and received by the profile of the housing. The tubular is translatable with respect to the housing based on the pin translating along the path defined by the profile. The slip activation member is connected to the tubular. The slip activation member is configured to move each of the engagement slips radially outward with respect to the housing when the pin translates to the second end of the path.

20 Claims, 6 Drawing Sheets

(58) Field of Classification Search
USPC ..... 166/242.6
See application file for complete search history.

(56) References Cited

U.S. PATENT DOCUMENTS

| | | | | | |
|---|---|---|---|---|---|
| 1,591,264 | A * | 7/1926 | Baash | E21B 31/107 | 294/86.23 |
| 2,377,249 | A * | 5/1945 | Lawrence | E21B 23/04 | 166/212 |
| 2,734,581 | A * | 2/1956 | Bonner | E21B 31/107 | 166/138 |
| 2,762,438 | A * | 9/1956 | Naylor | E21B 31/00 | 166/301 |
| 2,887,162 | A * | 5/1959 | Le Bus, Sr. | E21B 31/00 | 294/86.34 |
| 2,912,273 | A | 11/1959 | Chadderdon et al. | | |
| 2,947,362 | A * | 8/1960 | Smith | E21B 31/20 | 166/178 |
| 2,965,175 | A | 12/1960 | Ransom | | |
| 2,965,177 | A | 12/1960 | Le Bus et al. | | |
| 2,965,183 | A * | 12/1960 | Le Bus, Sr. | E21B 31/00 | 166/240 |
| 3,005,506 | A * | 10/1961 | Le Bus, Sr. | E21B 31/20 | 166/99 |
| 3,747,674 | A * | 7/1973 | Murray | E21B 31/16 | 166/98 |
| 3,752,230 | A * | 8/1973 | Bernat | E21B 31/18 | 166/98 |
| 4,877,085 | A * | 10/1989 | Pullig, Jr. | E21B 31/20 | 166/98 |
| 5,054,833 | A | 10/1991 | Bishop et al. | | |
| 5,580,114 | A | 12/1996 | Palmer | | |
| 5,584,342 | A * | 12/1996 | Swinford | E21B 17/021 | 166/301 |
| 5,673,754 | A * | 10/1997 | Taylor, Jr. | E21B 31/107 | 166/301 |
| 7,051,810 | B2 * | 5/2006 | Clemens | E21B 41/00 | 166/117.6 |
| 7,965,175 | B2 | 6/2011 | Yamano | | |
| 11,035,190 | B2 * | 6/2021 | Neacsu | E21B 23/01 | |
| 2005/0056427 | A1 * | 3/2005 | Clemens | E21B 31/00 | 166/66.4 |
| 2012/0285684 | A1 * | 11/2012 | Crow | E21B 29/005 | 166/54.5 |
| 2014/0251616 | A1 * | 9/2014 | O'Rourke | E21B 33/146 | 166/55.7 |
| 2016/0076327 | A1 * | 3/2016 | Glaser | E21B 23/04 | 166/301 |
| 2019/0284894 | A1 * | 9/2019 | Schmidt | E21B 23/01 | |
| 2021/0054710 | A1 * | 2/2021 | Neacsu | E21B 23/01 | |
| 2021/0262307 | A1 * | 8/2021 | Neacsu | E21B 23/006 | |

FOREIGN PATENT DOCUMENTS

| | | | | |
|---|---|---|---|---|
| CN | 107060679 | | 8/2017 | |
| CN | 107060679 | A * | 8/2017 | E21B 31/18 |
| CN | 107191152 | | 9/2017 | |
| CN | 107191152 | A * | 9/2017 | |
| CN | 107227939 | | 10/2017 | |
| CN | 107227939 | A * | 10/2017 | |
| WO | WO 9639570 | | 12/1996 | |
| WO | WO-9639570 | A1 * | 12/1996 | E21B 17/021 |

OTHER PUBLICATIONS

GCC Examination Report in GCC Appln. No. GC2020-40299, dated Oct. 14, 2021, 4 pages.

* cited by examiner

FISH RETRIEVAL FROM WELLBORE

CROSS-REFERENCE TO RELATED APPLICATION

This application is a continuation of and claims priority to U.S. patent application Ser. No. 16/544,616, filed on Aug. 19, 2019, the entire contents of which are incorporated by reference herein.

TECHNICAL FIELD

This disclosure relates to wellbore operations.

BACKGROUND

A number of problems can occur while drilling a well. For example, a drillstring or a bit can break and fall to the bottom of a well. Stray equipment that has fallen into a well can be referred as "fish". Typically, regular drill bits do not drill through fish. Should a fish fall into a well, fish retrieval operations (also referred to as fishing) are required to remove the fish. Drilling cannot occur during fishing. In some cases, fishing may take days to complete before drilling can continue. Pauses in drilling while fishing constitute undesirable well downtime.

SUMMARY

This disclosure describes technologies relating to fish retrieval from wellbores.

Certain aspects of the subject matter can be implemented as an apparatus. The apparatus includes a housing, multiple engagement slips, a tubular, a taper tap, a pin, and a slip activation member. The housing includes a profile that defines a path including a first end and a second end. The engagement slips are attached to the housing. The tubular passes through an opening of the housing. The taper tap is rotatable and connected to the housing. The pin is connected to the tubular and received by the profile of the housing. The tubular is translatable with respect to the housing based on the pin translating along the path defined by the profile. The slip activation member is connected to the tubular. The slip activation member is configured to move each of the engagement slips radially outward with respect to the housing when the pin translates to the second end of the path.

This, and other aspects, can include one or more of the following features.

The apparatus can include a motor disposed within the housing. The motor can be configured to rotate the taper tap.

The slip activation member can be configured to cause each of the engagement slips to protrude radially from the housing when the pin translates to the second end of the path.

The apparatus can include a sealing member fixed to the tubular. The sealing member can be configured to form a seal with an inner surface of the housing to isolate a portion of the housing within which the motor is disposed from a remaining portion of the housing.

The apparatus can include a slip retraction spring disposed within the housing. The slip retraction spring can be configured to bias the pin toward the first end of the path defined by the profile of the housing.

The slip retraction spring, the pin, the slip activation member, the sealing member, and the motor can be distributed longitudinally, in this order, within the housing.

The path between the first end and the second end defined by the profile can be a substantially S-shaped path.

The motor can be a hydraulic motor. The motor can be configured to rotate the taper tap in response to receiving fluid from the tubular.

The engagement slips can be biased radially inward with respect to the housing.

Certain aspects of the subject matter can be implemented as a method. A taper tap of an apparatus is engaged with a fish stuck in a wellbore. The apparatus includes a housing, multiple engagement slips, a tubular, a taper tap, a pin, and a motor. The housing includes a profile that defines a path. The engagement slips are attached to the housing. The tubular passes through an opening of the housing. The taper tap is connected to the housing. The pin is connected to the tubular and is received by the profile of the housing. The tubular is translatable with respect to the housing based on the pin translating along the path defined by the profile. The motor is disposed within the housing. The tubular is moved in a first direction, such that the pin connected to the tubular moves along the path toward an end of the path, thereby causing each of the engagement slips to protrude radially outward from the housing and engage with an inner wall of the wellbore. The motor is activated to apply torque on the fish via the taper tap to free the fish. After the fish has been freed, the tubular is moved in a second direction different from the first direction, such that the pin moves along the path away from the end of the path, thereby causing each of the engagement slips to disengage from the inner wall of the wellbore and retract radially into the housing. The fish engaged with the taper tap is retrieved from the wellbore.

This, and other aspects, can include one or more of the following features.

Engaging the taper tap with the fish can include activating the motor to rotate the taper tap while the taper tap is in contact with the fish.

Moving the tubular in the first direction, such that the pin moves along the path toward the end of the path can cause a slip activation member fixed to the tubular to push each of the engagement slips radially outward with respect to the housing.

The motor can be a hydraulic motor. Activating the motor can include flowing fluid through the tubular to the motor.

The engagement slips can be biased radially inward with respect to the housing. Moving the tubular in the second direction, such that the pin moves along the path away from the end of the path can cause the slip activation member to move away from the engagement slips, thereby allowing each of the engagement slips to retract radially into the housing.

Certain aspects of the subject matter described can be implemented as an apparatus. The apparatus includes a cylindrical housing, multiple engagement slips, a tubular, a taper tap, a motor, and a slip activation member. The cylindrical housing includes a profile formed on an inner surface of the cylindrical housing. The profile defines a meandering path including a first end and a second end. The engagement slips are attached to the cylindrical housing. The tubular passes through an inner portion of the cylindrical housing. The tubular includes a pin protruding from a circumferential surface of the tubular. The pin is disposed within the inner portion of the cylindrical housing. The pin is received by the profile of the cylindrical housing. The tubular is translatable with respect to the housing based on the pin translating along the meandering path defined by the profile. The taper tap is coupled to an outer portion of the cylindrical housing. The motor is disposed within the inner portion of the cylindrical housing and connected to the taper tap. The motor is configured to rotate the taper tap about a longitudinal axis of the cylindrical housing. The slip activation member is fixed to and protruding from the circumferential surface of the tubular. The slip activation member is disposed within the inner portion of the cylindrical housing. The slip activation member is configured to cause each of the engagement slips to protrude radially outward from the cylindrical housing when the pin translates to the second end of the meandering path.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes fish retrieval from wells. An apparatus including a taper tap and engagement slips can be used to retrieve a fish from a well. In some cases, fish can become stuck in a well. A fish that is stuck in a well may be more difficult to retrieve in comparison to a stray fish in a well. The apparatus described can be used to retrieve a fish that is stuck in a well. The taper tap can be used to secure the apparatus to the fish. The engagement slips can be used to secure the position of the apparatus within the well. Once the apparatus is secured in position within the well, and the taper tap is secured to the fish, torque can be applied to free the fish. Once the fish is free, the engagement slips can be disengaged freeing the apparatus to move again. The fish can then be retrieved from the well along with the apparatus. The subject matter described in this disclosure can be implemented in particular implementations, so as to realize one or more of the following advantages. Because the apparatus can be anchored to the well (for example, by the engagement slips engaged with the casing), torque can be applied to break a connection (that is, free the fish) in contrast to conventional fishing tools that rely on overpull to free a stuck pipe. Fishing operations can be completed quickly and efficiently, thereby reducing fishing operation duration and in turn, reducing the amount of costs of down time associated with such operations. A low speed motor can be used to apply the necessary torque to free the fish. The torque provided by the motor can be transmitted directly to the taper tap that is engaged to the fish to break the connection of the fish to the well without exposing a remaining portion of the work string to the torque. This feature mitigates the risk of accidental breakage of other tubular connections (such as drill pipe connections), which can happen during conventional backoff fishing operations. For example, in a vertical well, using the apparatus can ensure that the connection that is broken is downhole of the fish and not in the drill pipe that is uphole of the fish.

Figure 1A:
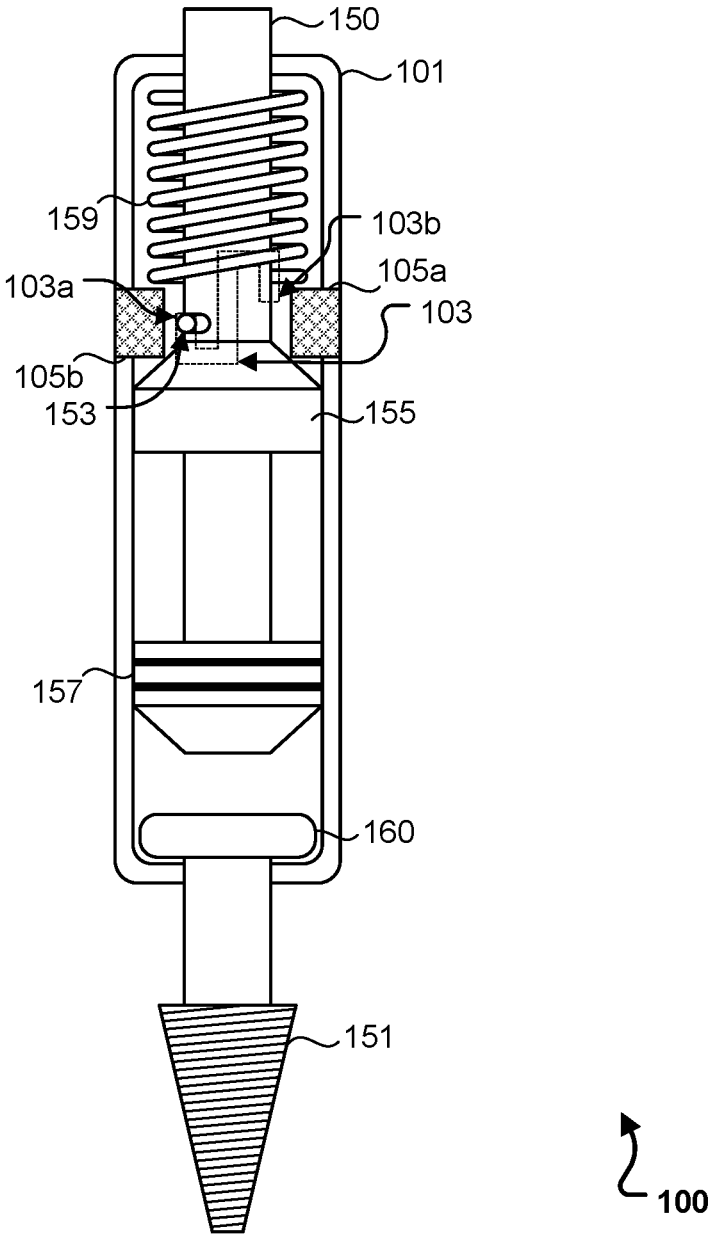
FIG. 1A is a schematic diagram of an example apparatus that can be used to retrieve a fish from a wellbore in a first configuration.

FIG. 1A is a schematic diagram of an example apparatus 100 that can be used to retrieve a fish from a wellbore. The apparatus 100 includes a housing 101, at least two engagement slips (105*a*, 105*b*), a tubular 150, a taper tap 151, a pin 153, and a slip activation member 155. The apparatus 100 can include a sealing member 157, a slip retraction spring 159, and a motor 160. The tubular 150 can be any tubular that can be run into a well. For example, the tubular 150 can be a part of a drillstring, casing, liner, or tubing string that can potentially become mechanically or differentially stuck in a wellbore during deployment.

The housing 101 can be cylindrical (for example, tubular). The housing 101 can include a profile 103 that defines a path having a first end 103*a* and a second end 103*b*. The profile 103 can be, for example, a raised or indented profile formed on an inner circumferential surface of the housing 101. In the case of an indented profile, the profile 103 can be, for example, a slot that can receive a pin (for example, the pin 153). The path can be a meandering path. That is, the path changes direction at least twice between the first end 103*a* and the second end 103*b*. In some implementations, the path is a substantially S-shaped path. The housing 101 can have an opening (for example, on an end of the housing 101), such that a tubular (such as the tubular 150) can pass through the opening and at least a portion of the tubular can reside within an inner portion of the housing 101.

The taper tap 151 can be coupled to the housing 101. In some implementations, the taper tap 151 is coupled to an outer portion of the housing 101. The taper tap 151 can be used to engage an internal diameter of a fish (such as a drillpipe or drill collar). The taper tap 151 includes an outer threaded profile and can be rotated with respect to the housing 101. By rotating the taper tap 151 when it is in contact with a fish, a threaded profile can be cut into the fish, enabling the taper tap 151 to securely engage the fish so that the fish may be retrieved.

The taper tap 151 can be rotated by using the motor 160. The motor 160 can be disposed within the inner portion of the cylindrical housing and connected to the taper tap 151. The motor 160 can be configured to rotate the taper tap 151, for example, about a longitudinal axis of the housing 101. In some implementations, the motor 160 is a hydraulic motor configured to rotate the taper tap 151 in response to receiving fluid from the tubular 150. As a non-limiting example, the motor 160 can be a high torque, low speed (for example, from 5 revolutions per minute (rpm) to 10 rpm), positive displacement mud motor. The motor 160 can provide torque to the taper tap 151 that is greater than a make-up torque of a stuck fish. The motor 160 can provide enough torque to the taper tap 151 to break a connection between the fish and another component in the well. For example, for a tubing with an outer diameter of 3.5 inches and a nominal weight of 9.3 pounds per foot (lb/ft), the motor 160 can be designed to provide torque of at least 2,890 pound-feet (lbf-ft). As another example, for a tubing with an outer diameter of 4.5 inches and a nominal weight of 11.6 lb/ft, the motor 160 can be designed to provide torque of at least 3,800 lbf-ft.

The pin 153 is connected to the tubular 150 and can be received by the profile 103 of the housing 101. The pin 153 can protrude from a circumferential surface of the tubular 150 and can be disposed within the inner portion of the housing 101. The pin 153 can be fixed to the tubular 150 or be integral to the tubular 150 (that is, the pin 153 and the tubular 150 are both part of a unitary body). When the pin 153 is received by the profile 103 of the housing 101, the tubular 150 is translatable with respect to the housing 101 based on the pin 153 translating along the path defined by the profile 103.

The engagement slips 105*a* and 105*b* can be attached to the housing 101. In some implementations, the engagement slips 105*a* and 105*b* can be biased radially inward with respect to the housing 101. For example, the engagement slips 105*a* and 105*b* can be spring-loaded, so that they are biased radially inward with respect to the housing 101. In some implementations, when the engagement slips 105*a* and 105*b* are in a "non-engaged" state, the outer portion of the engagement slips 105*a* and 105*b* can be flush with or retracted within the outer circumferential surface of the housing 101. When the engagement slips 105*a* and 105*b* are in an "engaged" state, at least a portion of each of the engagement slips 105*a* and 105*b* can protrude radially outward from the outer circumferential surface of the housing 101. Although shown as having two engagement slips (105*a*, 105*b*), the apparatus 100 can include additional engagement slips.

The slip activation member 155 can be fixed to the circumferential surface of the tubular 150. The slip activation member 155 can protrude from the circumferential surface of the tubular 150. The slip activation member 155 is configured to move the engagement slips 105*a* and 105*b* from the non-engaged state to the engaged state. When the pin 153 translates to the second end 103*b* of the path defined by the profile 103, the slip activation member 155 is configured to move the engagement slips 103*a* and 103*b* radially outward with respect to the housing 101. The slip activation member 155 can be configured to cause the engagement slips 103*a* and 103*b* to protrude radially outward from the housing 101.

When the slip activation member 155 causes the engagement slips 103*a* and 103*b* to protrude radially outward from the housing 101, the engagement slips 105*a* and 105*b* can engage with a wall of the well. The outer portion of the engagement slips 105*a* and 105*b* can be configured to engage with a wall of the well, for example, a wall of the wellbore (in an open hole portion of the well) or a wall of a tubular positioned in the wellbore (such as a casing in a cased portion of the well). In some implementations, the outer portion of the engagement slips 105*a* and 105*b* include a rough surface to facilitate engagement with the wall of the well. In some implementations, at least a portion of the engagement slips 105*a* and 105*b* (for example, the outer portion) is made of cast iron, hard face iron, or a steel alloy that has a hardness that is greater than the hardness of the wall of the well (for example, the casing) to which the engagement slips 105*a* and 105*b* will engage.

When the engagement slips 105*a* and 105*b* engage with a wall of the well (for example, a wall of the wellbore in an open hole portion of the well or a wall of the casing), the housing 101 can be secured in position relative to the well. In this configuration (that is, engagement slips 105*a* and 105*b* engaged with a wall of the well), components disposed within the housing 101 (such as the slip retraction spring 159) and components coupled to the housing 101 (such as the taper tap 151) can move, while the housing 101 itself remains fixed in position relative to the well.

The sealing member 157 can be fixed to the tubular 150. The sealing member 157 can be configured to form a seal with an inner surface of the housing 101 (for example, the inner circumferential surface of the housing 101) to isolate a portion of the housing 101 within which the motor 160 is disposed from a remaining portion of the housing 101. Because the sealing member 157 is fixed to the tubular 150, the sealing member 157 can move with the tubular 150 within the housing 101.

The slip retraction spring 159 can be disposed within the housing 101. The slip retraction spring 159 can be configured to bias the pin 153 toward one of the ends (103*a* or 103*b*) of the path defined by the profile 103.

Figure 1B:
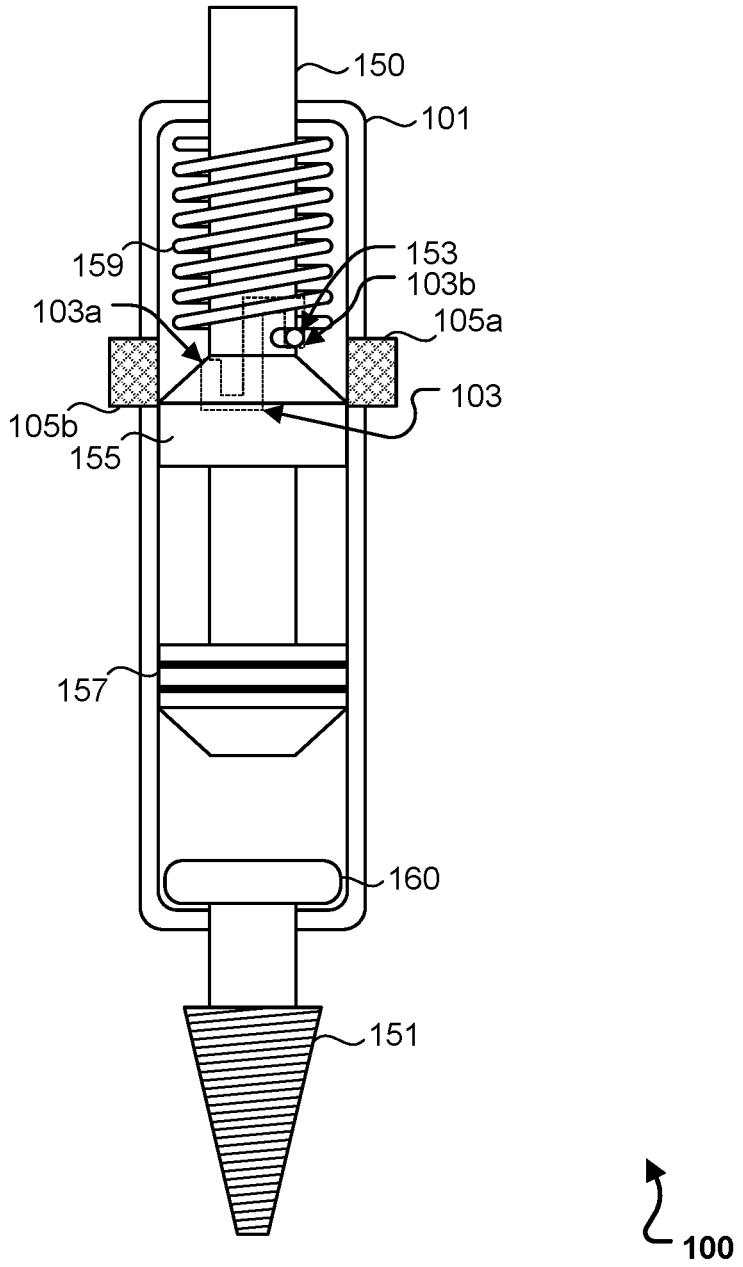
FIG. 1B is a schematic diagram of the apparatus of FIG. 1A in a second configuration different from the first configuration.

FIG. 1B is a schematic diagram of the apparatus of FIG. 1A with its engagement slips 105*a* and 105*b* in the engaged state. As shown, the pin 153 is positioned at the second end 103*b* of the path, and the slip activation member 155 is pushing the engagement slips 105*a* and 105*b* outward such that they are protruding radially outward from the housing 101. The slip retraction spring 159 is biasing the pin 153 toward the second end 103*b* of the path, so that the slip activation member 155 remains in position and maintains protrusion of the engagement slips 105*a* and 105*b* from the housing 101. To disengage the engagement slips 105*a* and 105*b*, the tubular 150 can be moved in such a manner to translate the pin 153 toward the first end 103*a* of the path. During this process of disengagement, enough force is necessary at least in the beginning of the disengagement process to counteract the biasing force exerted by the slip retraction spring 159 in order to translate the pin 153 away from the second end 103*b* of the path. As the pin 153 translates toward the first end 103*a* of the path, the slip activation member 155 can move away from the engagement slips 105*a* and 105*b*, thereby allowing them to disengage from the wall of the well and retract. The apparatus 100 can return to the configuration shown in FIG. 1A.

The wellbore of the well is typically, although not necessarily, cylindrical. All or a portion of the wellbore is lined with a tubular, such as casing. The casing connects with a wellhead at the surface and extends downhole into the wellbore. The casing operates to isolate the bore of the well, defined in the cased portion of the well by the inner bore of the casing, from the surrounding Earth. The casing can be formed of a single continuous tubing or multiple lengths of tubing joined (for example, threadedly) end-to-end. The casing can be perforated in the subterranean zone of interest to allow fluid communication between the subterranean zone of interest and the bore of the casing. In some implementations, the casing is omitted or ceases in the region of the subterranean zone of interest. This portion of the well without casing is often referred to as "open hole." In particular, casing can be commercially produced in a number of common sizes specified by the American Petroleum Institute (API), including 4½, 5, 5½, 6, 6⅝, 7, 7⅝, 16/8, 9⅝, 10¾, 11¾, 13⅜, 16, 116/8 and 20 inches, and API specifies internal diameters for each casing size. As mentioned previously, a fish may become stuck in a well. The apparatus 100 can be used to free a fish and retrieve that fish from the well.

Figure 2C:
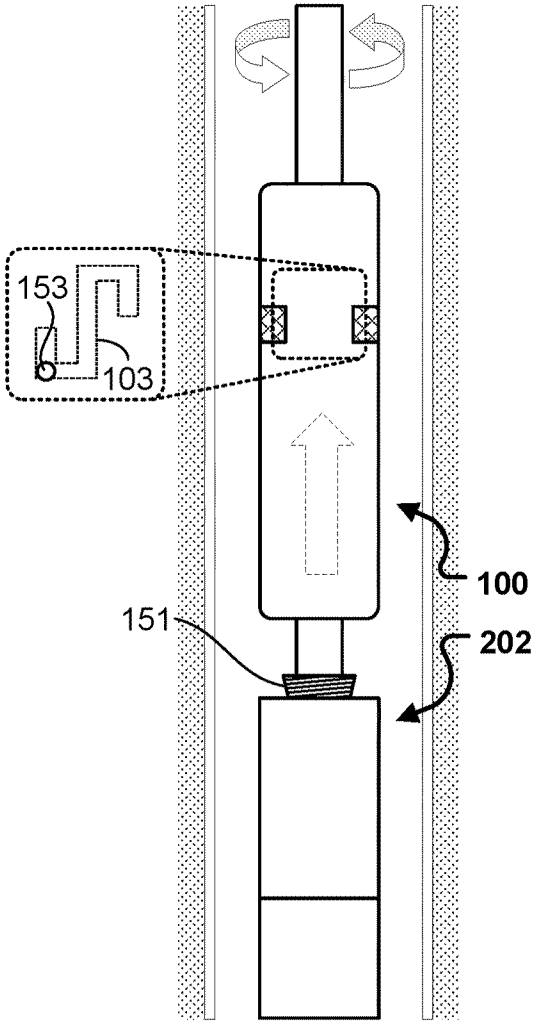
FIGS. 2A, 2B, 2C, 2D, 2E, 2F, 2G, 2H, and 2J are schematic diagrams showing a progression of steps for using the apparatus of FIG. 1A to retrieve a fish from a wellbore.
Figure 2B:
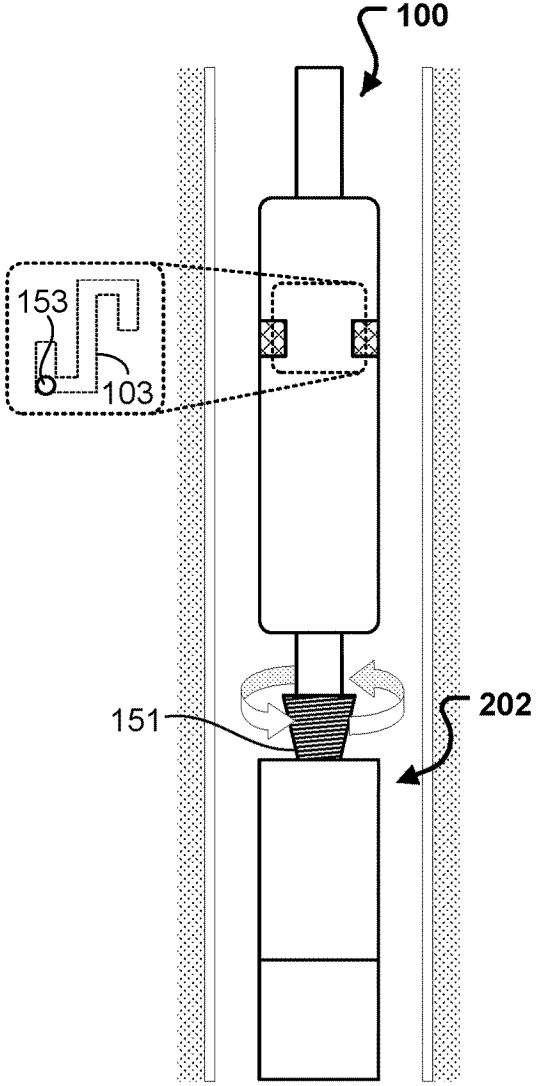
Figure 2A:
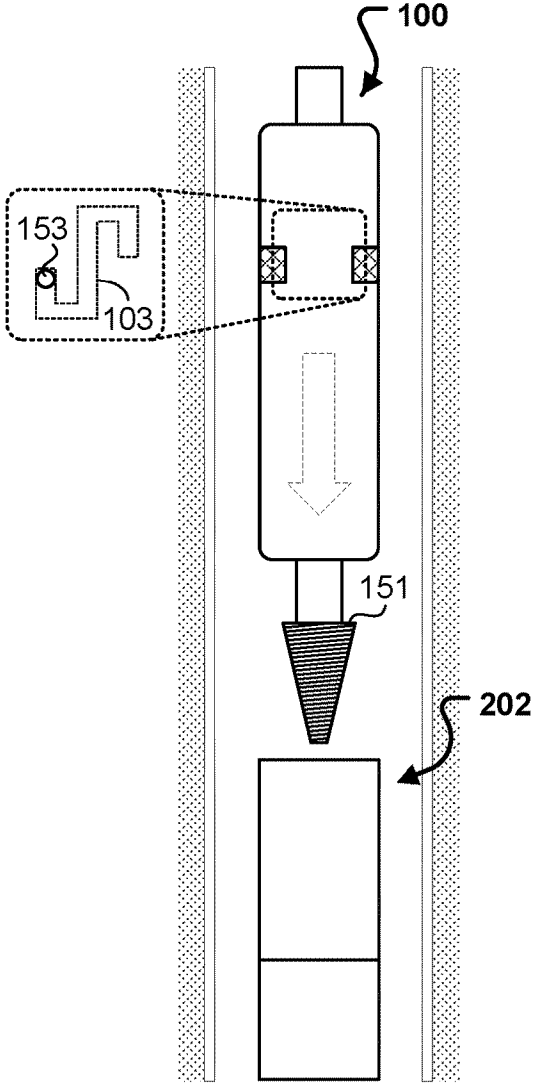

FIGS. 2A, 2B, 2C, 2D, 2E, 2F, 2G, 2H, and 2J are schematic diagrams showing a progression of steps for using the apparatus 100 to retrieve a fish from a wellbore. FIG. 2A shows the apparatus 100 run into a well to a depth proximal to a fish 202. The apparatus 100 can be moved closer to the fish 202, such that the taper tap 151 enters a hollow portion of the fish 202. At this point, the pin 153 is still at or near the first end 103*a* of the path defined by the profile 103.

FIG. 2B shows the apparatus 100 with its taper tap 151 engaged with the fish 202. The taper tap 151 can be rotated (for example, by using the motor 160) to secure the connection between the taper tap 151 and the fish 202. During this process, the tubular 150 can be moved such that the pin 153 translates away from the first end 103*a* of the path defined by the profile 103.

FIG. 2C shows the apparatus 100 with its taper tap 151 secured to the fish 202. The tubular 150 can then be moved (for example, upward and rotated) such that the pin 153 translates further away from the first end 103*a* and toward the second end 103*b* of the path defined by the profile 103. This movement can cause the slip activation member 155 to move the engagement slips 105*a* and 105*b*.

Figure 2F:
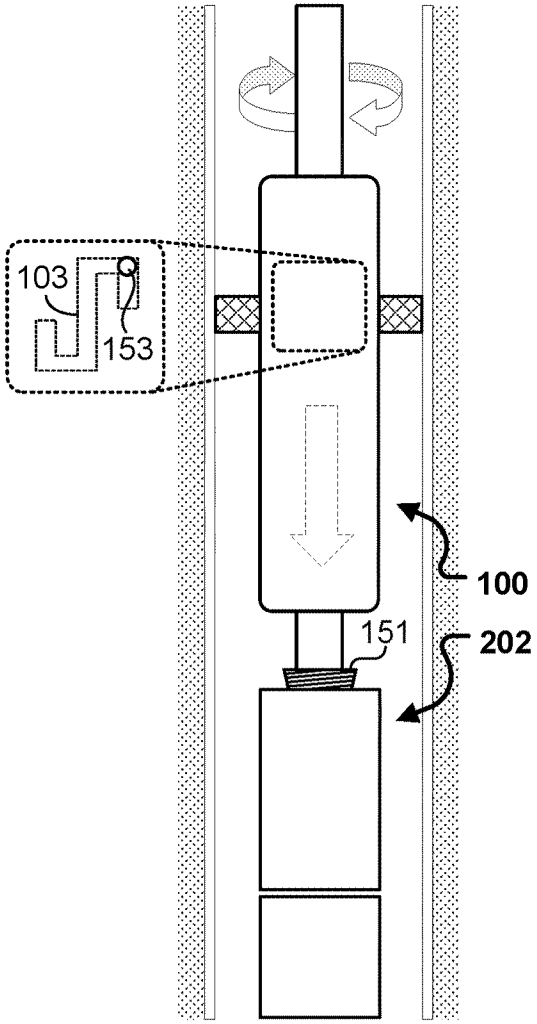
Figure 2E:
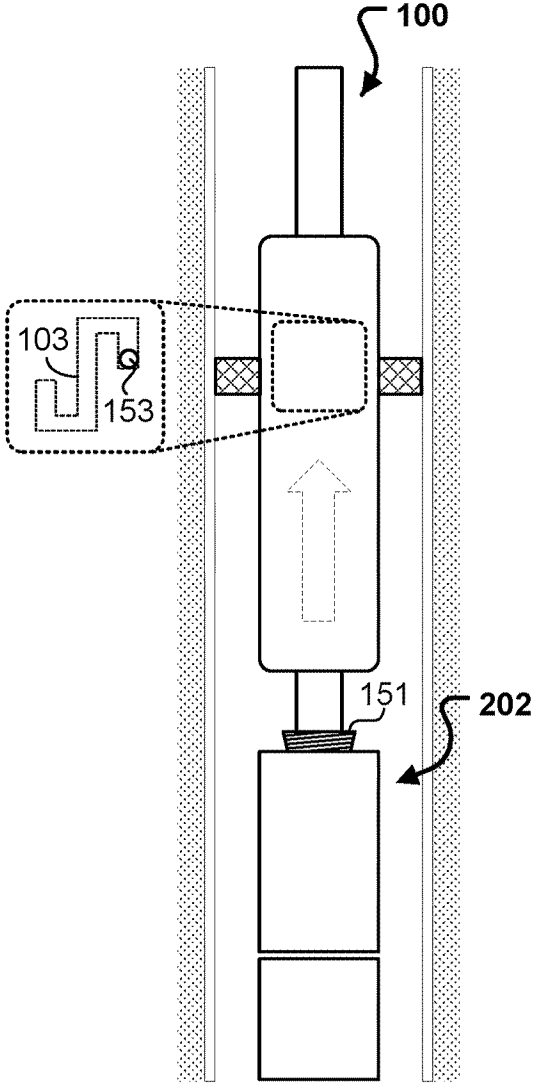
Figure 2D:
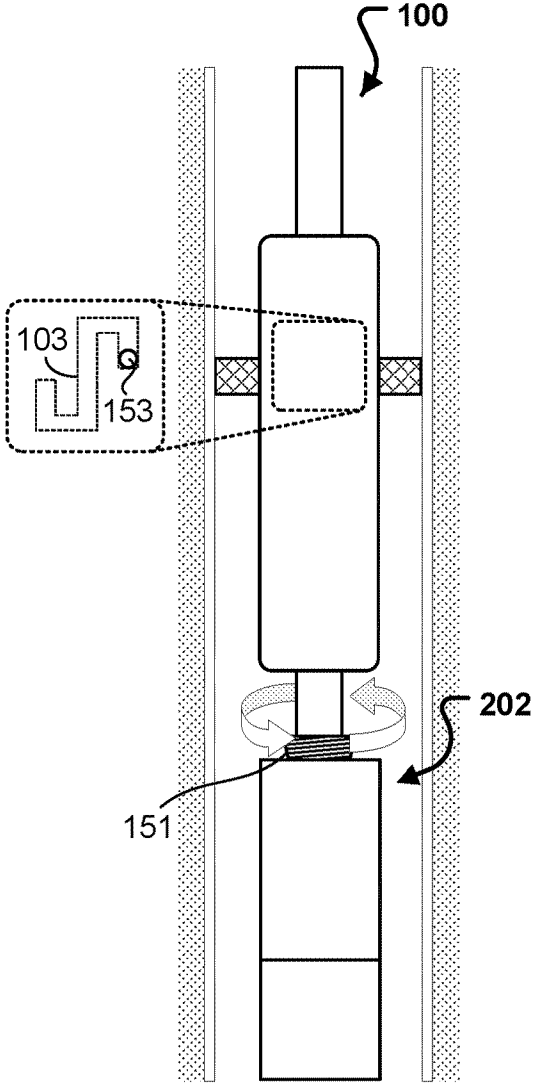

FIG. 2D shows the apparatus 100 with its pin 153 at or near the second end 103*b* of the path defined by the profile 103. At this point, the slip activation member 155 has caused the engagement slips 105*a* and 105*b* to protrude from the housing 101 and engage with the wall of the well (in this instance, the casing). The engagement slips 105*a* and 105*b* secure the position of the housing 101 relative to the well. The taper tap 151 can be further rotated in order to free the fish 202. In this example, the fish 202 was stuck to another downhole component, and rotating the taper tap 151 (for example, by using the motor 160) can cause the fish 202 to detach from the other downhole component.

FIG. 2E shows the apparatus 100 secured to the fish 202, which has been freed. The tubular 150 can then be moved (for example, upward) such that the pin 153 translates away from the second end 103*b* of the path defined by the profile 103. This movement can be considered the start of the disengagement process of the engagement slips 105*a* and 105*b*.

Referring to FIG. 2F, the tubular 150 can then be moved (for example, downward and rotated) such that the pin 153 translates further away from the second end 103*b* and toward the first end 103*a* of the path defined by the profile 103. This movement can cause the slip activation member 155 to move and allow the engagement slips 105*a* and 105*b* return to their original position relative to the housing 101.

Figure 2J:
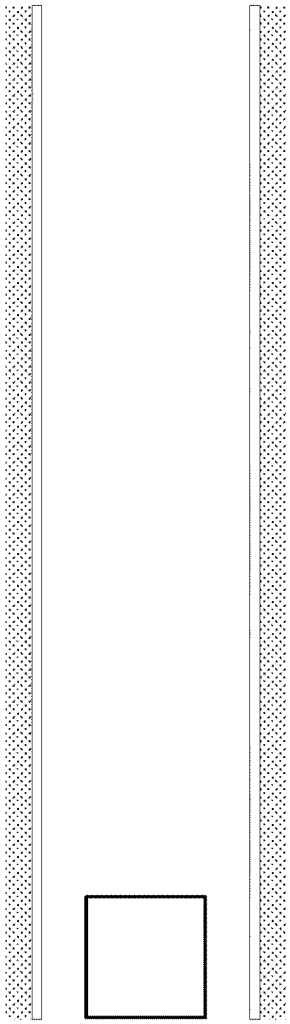
Figure 2H:
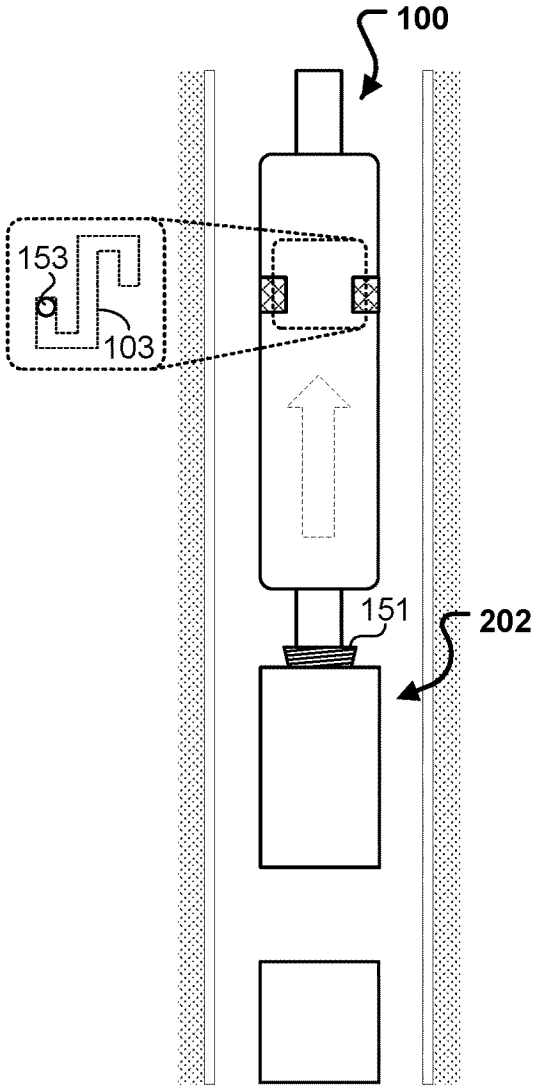
Figure 2G:
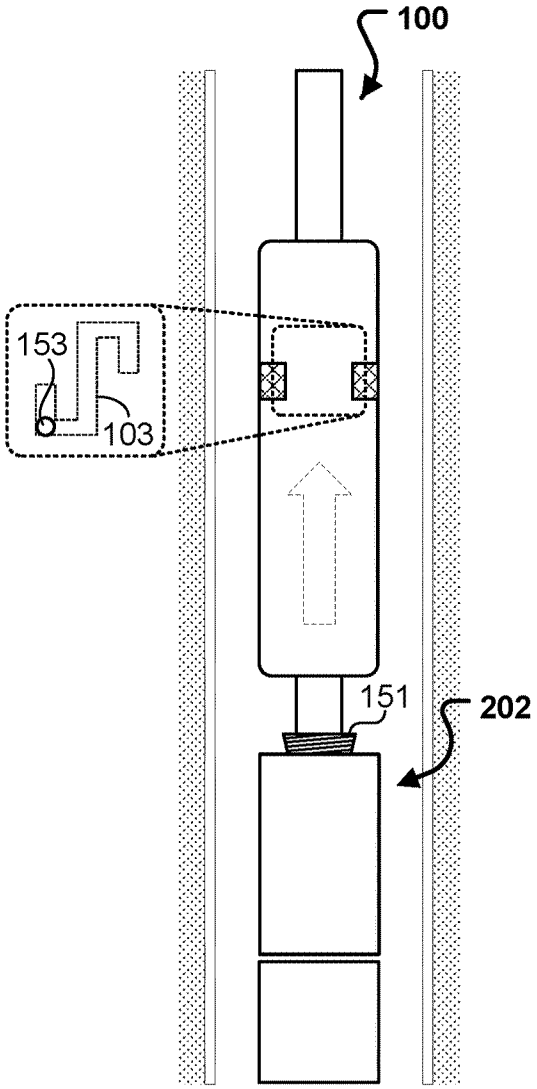

FIG. 2G shows the apparatus 100 with its pin 153 near the first end 103*a* of the path defined by the profile 103. At this point, the slip activation member 155 has moved away from the engagement slips 105*a* and 105*b*, allowing them to disengage from the casing and retract to their original positions (that is, not protruding from the housing 101). Now that the engagement slips 105*a* and 105*b* have returned to their non-engaged state, the housing 101 is again free to move relative to the well.

FIG. 2H shows the apparatus 100 secured to the fish 202 and being pulled out of the well. Once the fish 202 has been recovered from the well (as shown in FIG. 2J), operations can continue. For example, the apparatus 100 can be re-used to retrieve another fish or drilling can continue.

Figure 3:
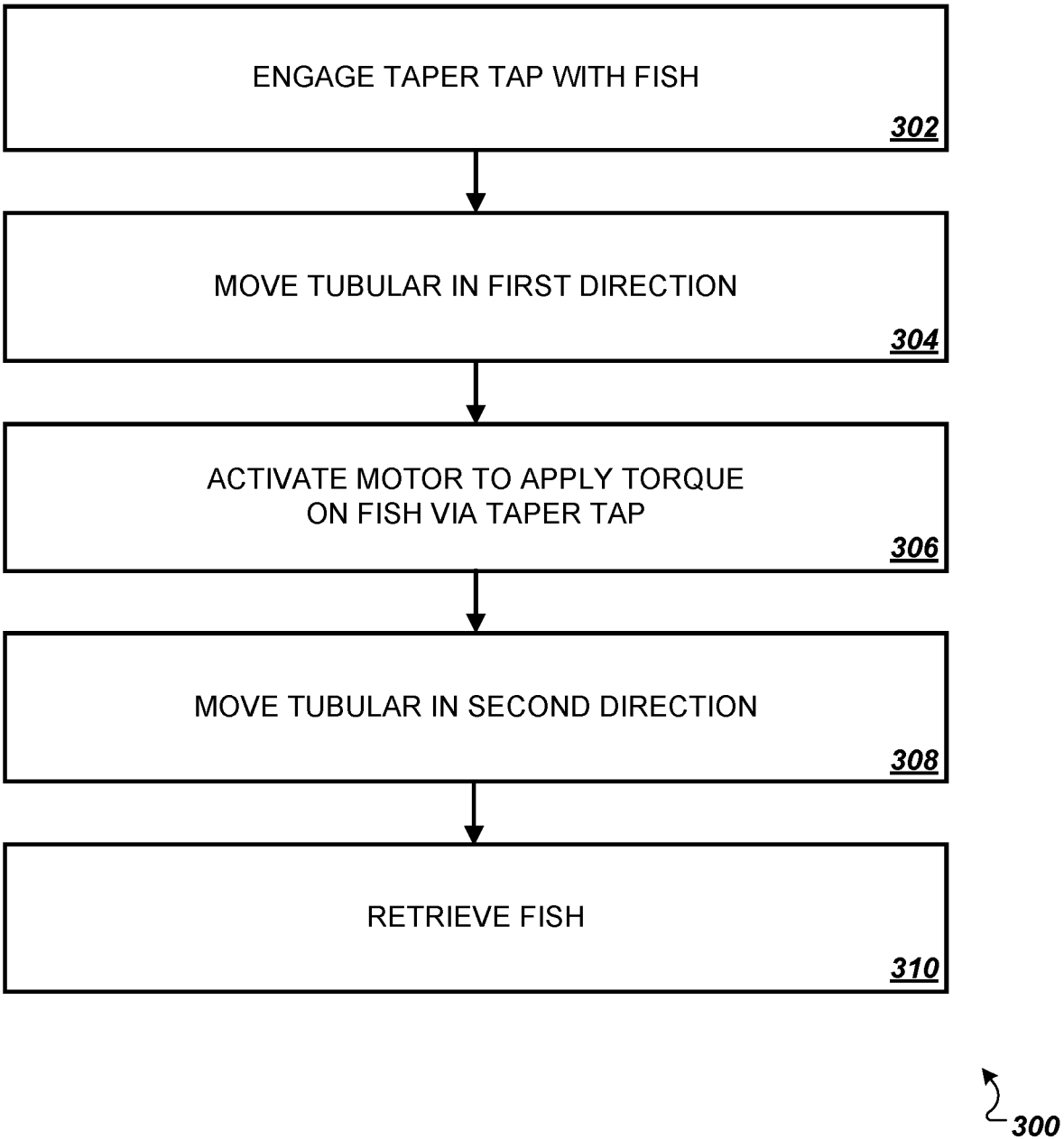
FIG. 3 is a flow chart of an example method for retrieving a fish from a wellbore.

FIG. 3 is a flow chart of an example method 300 for retrieving a fish from a wellbore. The apparatus 100 can be used to implement method 300. At step 302, a taper tap (for example, the taper tap 151) engages with a fish (for example, the fish 202) that is stuck in a wellbore. The taper tap 151 can be engaged with the fish 202, for example, by activating a motor (for example, the motor 160) to rotate the taper tap 151 while the taper tap 151 is in contact with the fish 202. An example progression of step 302 is illustrated in FIGS. 2A and 2B.

At step 304, a tubular (for example, the tubular 150) is moved in a first direction, such that a pin fixed on the tubular (for example, the pin 153) moves along a path defined by a profile (for example, the profile 103) of a housing (for example, the housing 101) and toward an end of the path (for example, toward the second end 103*b* of the path). Moving the tubular 150 in the first direction causes two or more engagement slips (for example, the engagement slips 105*a* and 105*b*) to protrude radially outward from the housing 101 and engage with an inner wall of the wellbore (for example, a casing or an inner wall of an openhole portion of the wellbore). For example, moving the tubular 150 at step 304 can cause a slip activation member (such as the slip activation member 155 to push the engagement slips 105*a* and 105*b* radially outward with respect to the housing 101.

Moving the tubular 150 in the first direction can include, for example, moving the tubular 150 in such a manner to cause the pin 153 to translate along the path, away from the first end 103*a* and toward the second end 103*b*. Moving the tubular 150 at step 304 can include moving the tubular 150 longitudinally with respect to the housing 101. Moving the tubular 150 at step 304 can include moving the tubular 150 rotationally with respect to the housing 101. In some implementations, moving the tubular 150 at step 304 includes moving the tubular 150 longitudinally and rotationally with respect to the housing 101. An example of step 304 is illustrated in FIG. 2C.

At step 306, the motor 160 is activated to apply torque on the fish 202 via the taper tap 151 in order to free the fish 202. An example of step 306 is illustrated in FIG. 2D.

After the fish has been freed at step 306, the tubular 150 is moved in a second direction at step 308. The second direction is different from the first direction (of step 304). The tubular 150 is moved in the second direction at step 308, such that the pin 153 moves along the path defined by the profile 103 and away from the end of the path (for example, away from the second end 103*b* of the path). Moving the tubular 150 in the second direction causes the engagement slips 105*a* and 105*b* to disengage from the inner wall of the wellbore and retract radially into the housing 101. As mentioned previously, the engagement slips 105*a* and 105*b* can be biased radially inward with respect to the housing 101 (for example, the engagement slips 105*a* and 105*b* can be spring-loaded). Moving the tubular 150 at step 308 can cause the slip activation member 155 to move away from the engagement slips 105*a* and 105*b*, thereby allowing them to retract radially into the housing 101.

Moving the tubular 150 in the second direction can include, for example, moving the tubular 150 in such a manner to cause the pin 153 to translate along the path, toward the first end 103*a* and away from the second end 103*b*. Moving the tubular 150 at step 308 can include moving the tubular 150 longitudinally with respect to the housing 101. Moving the tubular 150 at step 308 can include moving the tubular 150 rotationally with respect to the housing 101. In some implementations, moving the tubular 150 at step 308 includes moving the tubular 150 longitudinally and rotationally with respect to the housing 101. In some implementations, moving the tubular 150 at step 308 is opposite of the movement of the tubular 150 at step 304. An example progression of step 308 is illustrated in FIGS. 2E, 2F, and 2G.

At step 310, the fish 202 engaged with the taper tap 151 is retrieved from the wellbore. An example progression of step 310 is illustrated in FIGS. 2H and 2J.

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

In this disclosure, "approximately" means a deviation or allowance of up to 10 percent (%) and any variation from a mentioned value is within the tolerance limits of any machinery used to manufacture the part. Likewise, "about" can also allow for a degree of variability in a value or range, for example, within 10%, within 5%, or within 1% of a stated value or of a stated limit of a range.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

While this disclosure contains many specific implementation details, these should not be construed as limitations on the subject matter or on what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Nevertheless, it will be understood that various modifications, substitutions, and alterations may be made. While operations are depicted in the drawings or claims in a particular order, this should not be understood as requiring that such operations be performed in the particular order shown or in sequential order, or that all illustrated operations be performed (some operations may be considered optional), to achieve desirable results. Accordingly, the previously described example implementations do not define or constrain this disclosure.

What is claimed is:

1. An apparatus comprising:

a housing comprising an indented profile defining a path;

a plurality of engagement slips attached to the housing;

a tubular;

a rotatable taper tap connected to the housing;

a motor disposed within the housing, wherein the motor is configured to rotate the rotatable taper tap;

a pin connected to the tubular and received by the indented profile of the housing, wherein the tubular is translatable with respect to the housing based on the pin translating along the path defined by the indented profile; and a slip activation member connected to the tubular, wherein, when the pin translates to an end of the path, the slip activation member is configured to move each of the engagement slips radially outward with respect to the housing.

2. The apparatus of claim 1, wherein, when the pin translates to the end of the path, the slip activation member is configured to cause each of the engagement slips to protrude radially from the housing.

3. The apparatus of claim 1, comprising a sealing member fixed to the tubular, the sealing member configured to form a seal with an inner surface of the housing to isolate a portion of the housing within which the motor is disposed from a remaining portion of the housing.

4. The apparatus of claim 3, comprising a slip retraction spring disposed within the housing, the slip retraction spring configured to bias the pin toward the end of the path defined by the indented profile of the housing.

5. The apparatus of claim 4, wherein the slip retraction spring, the pin, the slip activation member, the sealing member, and the motor are distributed longitudinally, in this order, within the housing.

6. The apparatus of claim 1, wherein the path defined by the indented profile is an S-shaped path.

7. The apparatus of claim 1, wherein the motor is a hydraulic motor, and the motor is configured to rotate the rotatable taper tap in response to receiving fluid.

8. The apparatus of claim 1, wherein the plurality of engagement slips are biased radially inward with respect to the housing.

9. A method comprising:

engaging, with a fish stuck in a wellbore, a taper tap of an apparatus, the apparatus comprising:

a housing comprising an indented profile defining a path;

a plurality of engagement slips attached to the housing;

a tubular;

the taper tap connected to the housing;

a pin connected to the tubular and received by the indented profile of the housing, wherein the tubular is translatable with respect to the housing based on the pin translating along the path defined by the indented profile; and a motor disposed within the housing;

moving the tubular in a first direction, such that the pin connected to the tubular moves along the path toward an end of the path, thereby causing each of the engagement slips to engage with an inner wall of the wellbore;

activating the motor to apply torque on the fish via the taper tap to free the fish;

after the fish has been freed, moving the tubular in a second direction different from the first direction, such that the pin moves along the path away from the end of the path, thereby causing each of the engagement slips to disengage from the inner wall of the wellbore; and retrieving the fish engaged with the taper tap from the wellbore.

10. The method of claim 9, wherein engaging the taper tap with the fish comprises activating the motor to rotate the taper tap while the taper tap is in contact with the fish.

11. The method of claim 10, wherein moving the tubular in the first direction, such that the pin moves along the path toward the end of the path causes a slip activation member fixed to the tubular to push each of the engagement slips radially outward with respect to the housing.

12. The method of claim 11, wherein the motor is a hydraulic motor, and activating the motor comprises flowing fluid to the motor.

13. The method of claim 11, wherein the plurality of engagement slips are biased radially inward with respect to the housing, and moving the tubular in the second direction, such that the pin moves along the path away from the end of the path causes the slip activation member to move away from the plurality of engagement slips, thereby allowing each of the engagement slips to retract radially into the housing.

14. An apparatus comprising:

a cylindrical housing comprising a profile formed on an inner surface of the cylindrical housing, the profile defining a path;

a plurality of engagement slips attached to the cylindrical housing;

a tubular comprising a pin protruding from a circumferential surface of the tubular, wherein the pin is received by the profile of the cylindrical housing, and the tubular is translatable with respect to the housing based on the pin translating along the path defined by the profile;

a taper tap coupled to an outer portion of the cylindrical housing;

a motor disposed within an inner portion of the cylindrical housing and connected to the taper tap, the motor configured to rotate the taper tap; and a slip activation member fixed to and protruding from the circumferential surface of the tubular, the slip activation member disposed within the inner portion of the cylindrical housing, wherein when the pin translates to an end of the path, the slip activation member is configured to cause each of the engagement slips to protrude from the cylindrical housing.

15. The apparatus of claim 14, wherein, when the pin translates to the end of the path, the slip activation member is configured to cause each of the engagement slips to protrude radially outward from the cylindrical housing.

16. The apparatus of claim 14, comprising a sealing member fixed to the tubular, the sealing member configured to form a seal with the inner surface of the cylindrical housing to isolate a portion of the cylindrical housing within which the motor is disposed from a remaining portion of the cylindrical housing.

17. The apparatus of claim 16, comprising a slip retraction spring disposed within the cylindrical housing, the slip retraction spring configured to bias the pin toward the end of the path defined by the profile of the cylindrical housing.

18. The apparatus of claim 17, wherein the slip retraction spring, the pin, the slip activation member, the sealing member, and the motor are distributed longitudinally, in this order, within the cylindrical housing.

19. The apparatus of claim 14, wherein the motor is a hydraulic motor, and the motor is configured to rotate the taper tap in response to receiving fluid.

20. The apparatus of claim 14, wherein the plurality of engagement slips are biased radially inward with respect to the cylindrical housing.

* * * * *